US008020228B2

(12) United States Patent
Rao et al.

(10) Patent No.: US 8,020,228 B2
(45) Date of Patent: Sep. 20, 2011

(54) SHOULDER SURGERY ATTACHMENT FOR A SURGICAL TABLE

(76) Inventors: Sudhir B. Rao, Big Rapids, MI (US); Keith J. Harper, Big Rapids, MI (US)

( * ) Notice: Subject to any disclaimer, the term of this patent is extended or adjusted under 35 U.S.C. 154(b) by 133 days.

(21) Appl. No.: 12/456,228

(22) Filed: Jun. 12, 2009

(65) Prior Publication Data

US 2009/0307845 A1 Dec. 17, 2009

Related U.S. Application Data

(60) Provisional application No. 61/131,992, filed on Jun. 13, 2008.

(51) Int. Cl.
*A47B 7/00* (2006.01)

(52) U.S. Cl. ..... 5/621; 5/622; 5/624; 5/633; 5/635; 5/632

(58) Field of Classification Search ..... 5/622, 624, 5/929, 634, 635, 633; 606/130; 128/857
See application file for complete search history.

(56) References Cited

U.S. PATENT DOCUMENTS

| | | | | |
|---|---|---|---|---|
| 3,188,079 | A | 6/1965 | Boetcker et al. | |
| 4,700,691 | A | 10/1987 | Tari et al. | |
| 4,979,519 | A | 12/1990 | Chavarria et al. | |
| 5,147,287 | A | 9/1992 | Jewell et al. | |
| 5,661,859 | A | 9/1997 | Schaefer | |
| 6,355,049 | B1 | 3/2002 | Gill | |
| 6,557,195 | B2 | 5/2003 | Dinkler | |
| 6,564,406 | B2 | 5/2003 | VanSteenburg et al. | |
| 7,036,169 | B2 * | 5/2006 | Marshall | 5/650 |
| 7,117,551 | B1 | 10/2006 | Dinkler, II et al. | |
| 7,306,612 | B1 | 12/2007 | Landa | |
| 7,654,974 | B2 * | 2/2010 | Bass | 602/32 |
| 2006/0103226 | A1 | 5/2006 | Wong et al. | |
| 2006/0224097 | A1 * | 10/2006 | Bass | 602/32 |
| 2008/0072381 | A1 | 3/2008 | Rolfes et al. | |

* cited by examiner

*Primary Examiner* — Robert G Santos
*Assistant Examiner* — Brittany Wilson
(74) *Attorney, Agent, or Firm* — Carothers & Carothers

(57) ABSTRACT

A shoulder surgery attachment for a surgical table having an articulated leg section with accessory attachment rails on opposite sides. An upright chair back assembly is supported at its base or bottom end thereof for attachment to the accessory attachment rails and the chair back assembly includes a headrest assembly positioned above a back support. The headrest assembly includes a removable neck support and a head fixation assembly. The headrest assembly is adjustably moveable up and down the chair back assembly. The neck support is positioned below the head fixation assembly and protrudes from the front of the headrest assembly for engagement with the back of the patient's neck. The head fixation assembly includes a forward protruding U-shaped forehead clamp having two distal rearwardly extending free ends that are adjustably secured to the headrest assembly whereby the head clamp may be adjusted for engaging the forehead of the patient to clamp the patient's head against the headrest assembly.

7 Claims, 7 Drawing Sheets

SHOULDER SURGERY ATTACHMENT FOR A SURGICAL TABLE

RELATED APPLICATIONS

This application is based upon U.S. Provisional Application Ser. No. 61/131,992, filed on Jun. 13, 2008, the complete disclosures of which are hereby expressly incorporated herein by this reference thereto.

BACKGROUND OF THE INVENTION

The present invention relates to surgical attachments for positioning a patient for surgical procedures and particularly to a shoulder surgery attachment for a surgical table.

Surgical procedures on the shoulders of patients are often preformed with the patients in the so called beach-chair position. In the beach-chair position, a patient is positioned in a sitting position during surgery, although the patient may be anesthetized in a supine line position.

There are presently a number of devices used for positioning patients in the beach-chair position as an accessory for common place surgical tables. As examples, refer to U.S. Pat. No. 5,661,859, issued to Schaefer, U.S. Pat. No. 6,564,406, issued to Van Steenburg et al. and US Application Publication No. 2006/0103226 in the name of Wong et al.

There are, however, problems with current surgical beach-chairs which include inadequate head, neck and torso support, ease of cleanliness and improper sizing. Existing designs fail to provide adequate back, neck and head support, or where support is provided it is difficult to use and cumbersome. Other problems include the use of flat pads for back support which can result in patient's sliding and spinal stresses and stresses to the neck resulting in possible neurabraxia, airway blockage or other damages.

SUMMARY OF THE INVENTION

The shoulder surgery attachment of the present invention is provided for attachment to a surgical table having accessory attachment rails on opposite sides, or a surgical table having an articulated leg section with accessory attachment rails on opposite sides thereof. The shoulder surgery attachment of the present invention is comprised of an upright chair back assembly which includes a back support and a base on the bottom end for attachment to the accessory attachment rails. It further includes a headrest assembly positioned above the back support that also includes a removable neck support and a head fixation assembly. The headrest assembly is adjustably moveable up and down the chair back assembly. The neck support is positioned below the head fixation assembly and protrudes from the front of the headrest assembly for engagement with the back of the patient's neck. The head fixation assembly includes a forward protruding U-shaped forehead clamp having two rearwardly extending distal free ends that are adjustably secured to the headrest assembly for engaging the clamp against the forehead of the patient to clamp the patient's head against the headrest assembly.

The headrest assembly is also adjustably moveable in a direction transverse to the upright extension of the chair back assembly. This permits proper engagement of the patient's neck in alignment with the back support.

The chair back assembly further includes side retainers that adjustably protrude in a forward direction on opposite sides. They are positioned for retaining and confining the sides of the patient's torso. A torso retainer is also preferably provided between these side retainers for retaining a patient's torso against the back support to assist in preventing the patient from sliding down the chair back assembly.

The forehead clamp includes at least one clamp pad for soft engagement of the patient's forehead. In addition, a contoured back rest support cushion is provided and positioned to freely slide against the chair back. This permits the back rest support cushion to "float" and thereby find the proper position. A knee lift support is also provided on the surgical table and positioned under the patient's knees.

BRIEF DESCRIPTION OF THE DRAWINGS

Other objects and advantages appear hereinafter in the following description and claims. The appended drawings show, for the purpose of exemplification, without limiting the scope of the invention or the appended claims, certain practical embodiments of the present invention wherein:

DETAILED DESCRIPTION OF A PREFERRED EMBODIMENT

Figure 1:
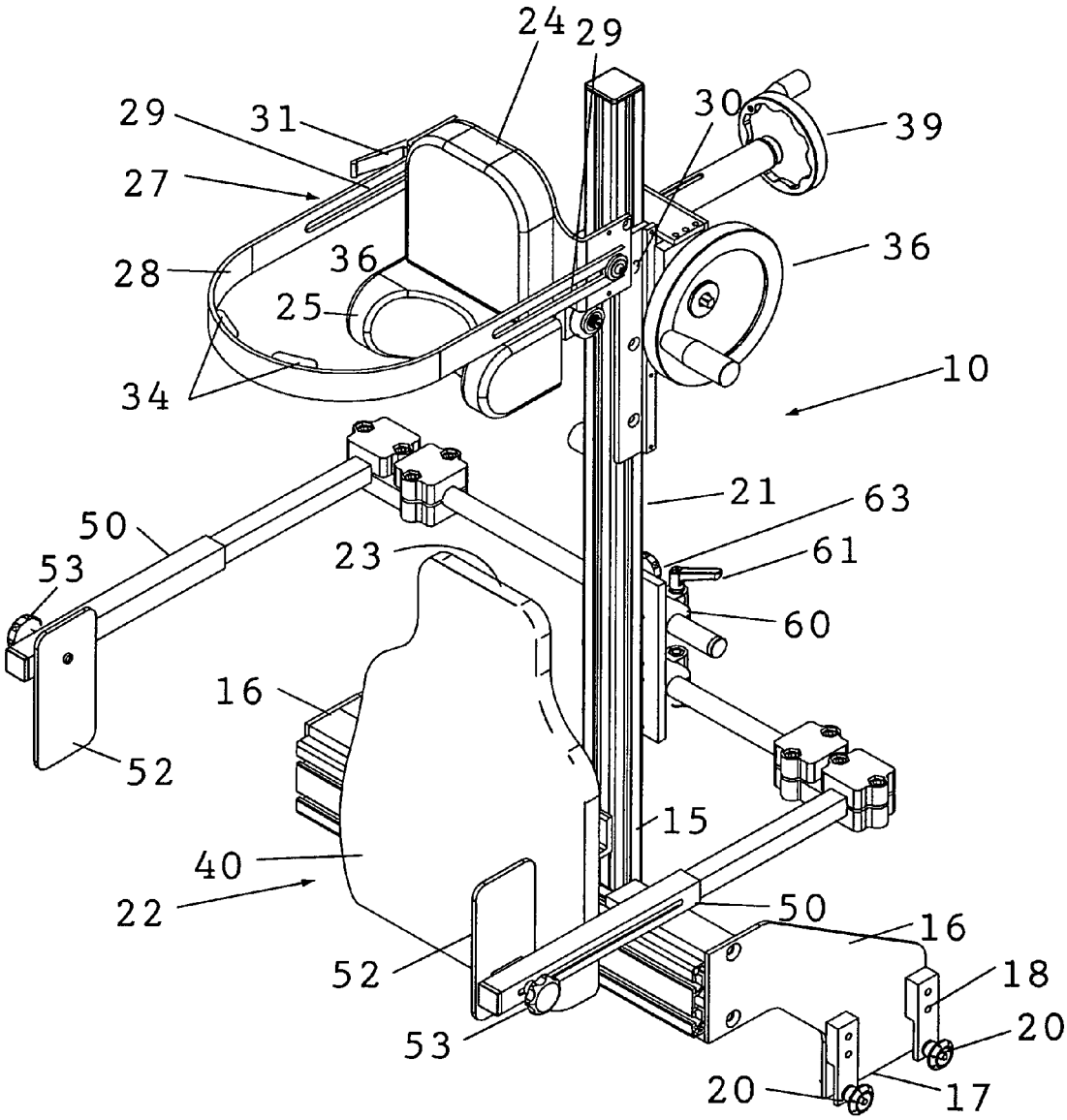
FIG. 1 is a perspective view of the shoulder surgery attachment of the present invention.

Referring to the drawings, the shoulder surgery attachment 10 of the present invention is provided for attachment to a common place surgery table 11 (FIG. 7) having an articulated leg section 12 with accessory attachment rails 13 on opposite sides thereof. The accessory attachment rails 13 are spaced from the sides of the articulated leg section 12 by means of periodically spaced standoff support pins 14. The details of such a typical surgical table are illustrated in U.S. Pat. No. 6,564,406, issued to Van Steenburg et al., and accordingly the disclosure therein is incorporated herein by reference for a full understanding of the surgical table construction. The attachment 10 may also be secured to accessory attachment rails on the surgery table 11 itself.

The shoulder surgery attachment 10 is provided at the base 15 thereof with spaced mount blades 16, that in turn are provided at their distal ends 17 with a rail clamp securement assembly 18. The assemblies 18 are provided with downwardly open slots 19 to permit the distal ends 17 of the blades 16 to drop over and secure over selected spacer pins 14 to hold the blades 16 in position. The blades 16 are then secured by screwing in the two clamps 20 to secure the shoulder surgery attachment 10 firmly to the rails 13 and thereby prevent accidental dislodgement.

The shoulder surgery attachment 10 is primarily supported from support post 21 that is rigidly secured between mount blades 16.

The shoulder surgery attachment 10 includes an upright chair back assembly 22, which further includes back support 23 rigidly secured to mount blades 16. Headrest assembly 24 is positioned above back support 23 and includes a removable neck support 25 that is secured to the back plate 26 of headrest assembly 24 by means of conventional securement such as hook and loop fastener such as manufactured under the trademark Velcro. Neck support 25 is made of a foam cushioning material and may be disposed after each use for sanitary purposes. Neck support 25 may also be provided in different sizes to fit the contours of different patients at the back of the neck.

Above neck support 25, head fixation assembly 27 is provided with a forward protruding substantially rigid U-shaped forehead clamp 28 having two distal free ends 29 that are adjustably secured to the headrest assembly 24. These rearwardly extending distal free ends 29 are secured to the headrest assembly 24 by means of a rotatable clamp mechanism 30 operated by handle 31. When clamp handle 31 is turned counterclockwise, the forehead clamp 28 may be rotated or pivoted about clamp mechanism 30 clockwise and counter clockwise as indicated by arrow 37 in FIG. 7, and the clamp mechanism 28 may further be slid forward or backward as indicated by arrow 38 to accommodate appropriate clamping contact with the forehead 32 of a patient 33. Replaceable head clamp pads 34 are temporarily secured to the inside of U-shaped forehead clamp 28 for soft engagement with the forehead 32 of the patient 33. In this manner the clamp 28 may be pulled or pushed in a rearward direction for engagement of the pads 34 against the patient's forehead 32 to thereby clamp the patient's head 35 against pad 36 of headrest assembly 24 and against neck support 25.

The headrest assembly 24 is also adjustably moveable up and down on support post 21 by the rotation of drive wheel 36 which rotates a drive gear to move the headrest assembly 24 up and down post 21 by reason of engagement of the drive gear with gear rack 38.

Figure 2:
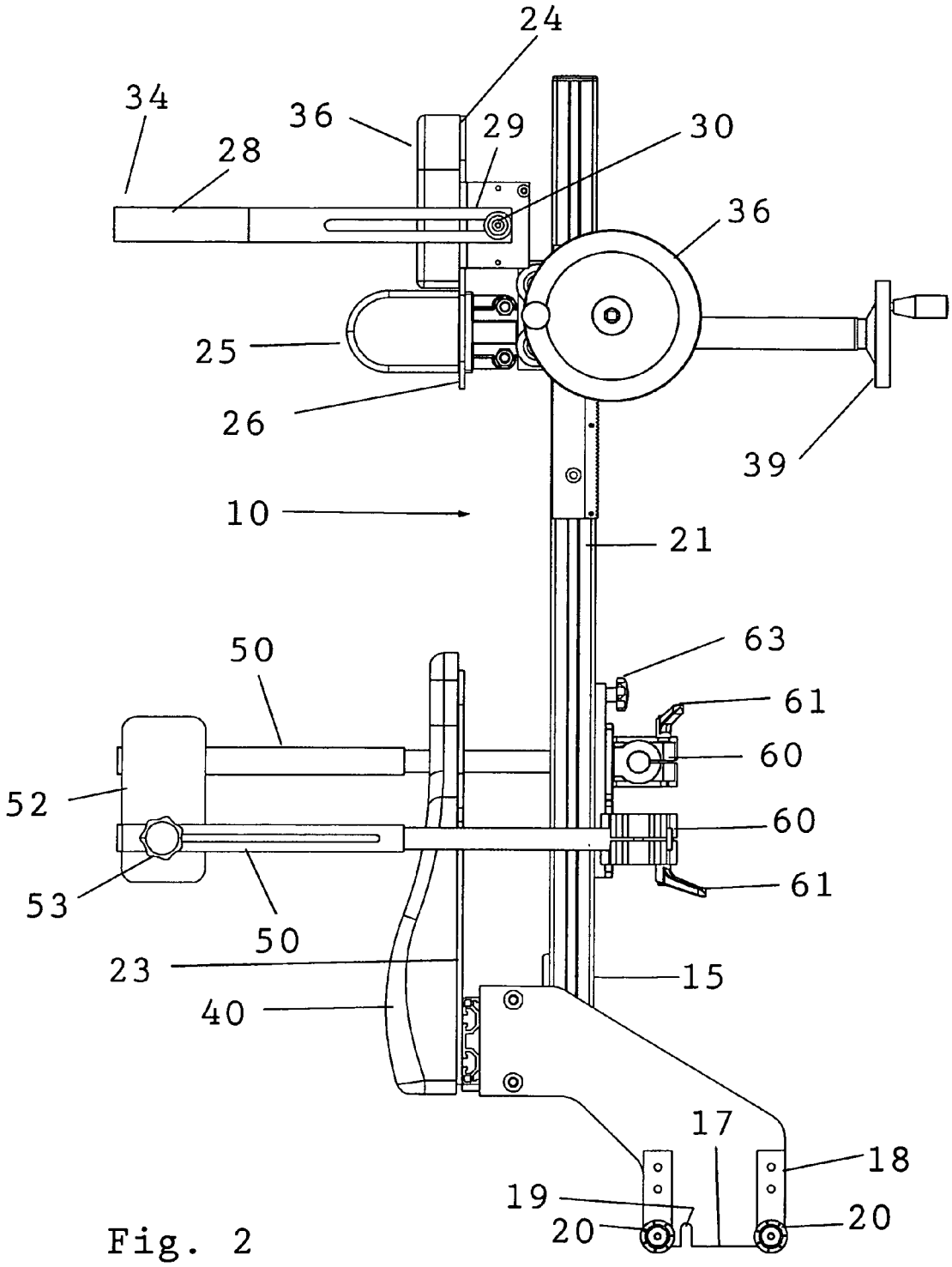
FIG. 2 is a left side view of the shoulder surgery attachment shown in FIG. 1.
Figure 3:
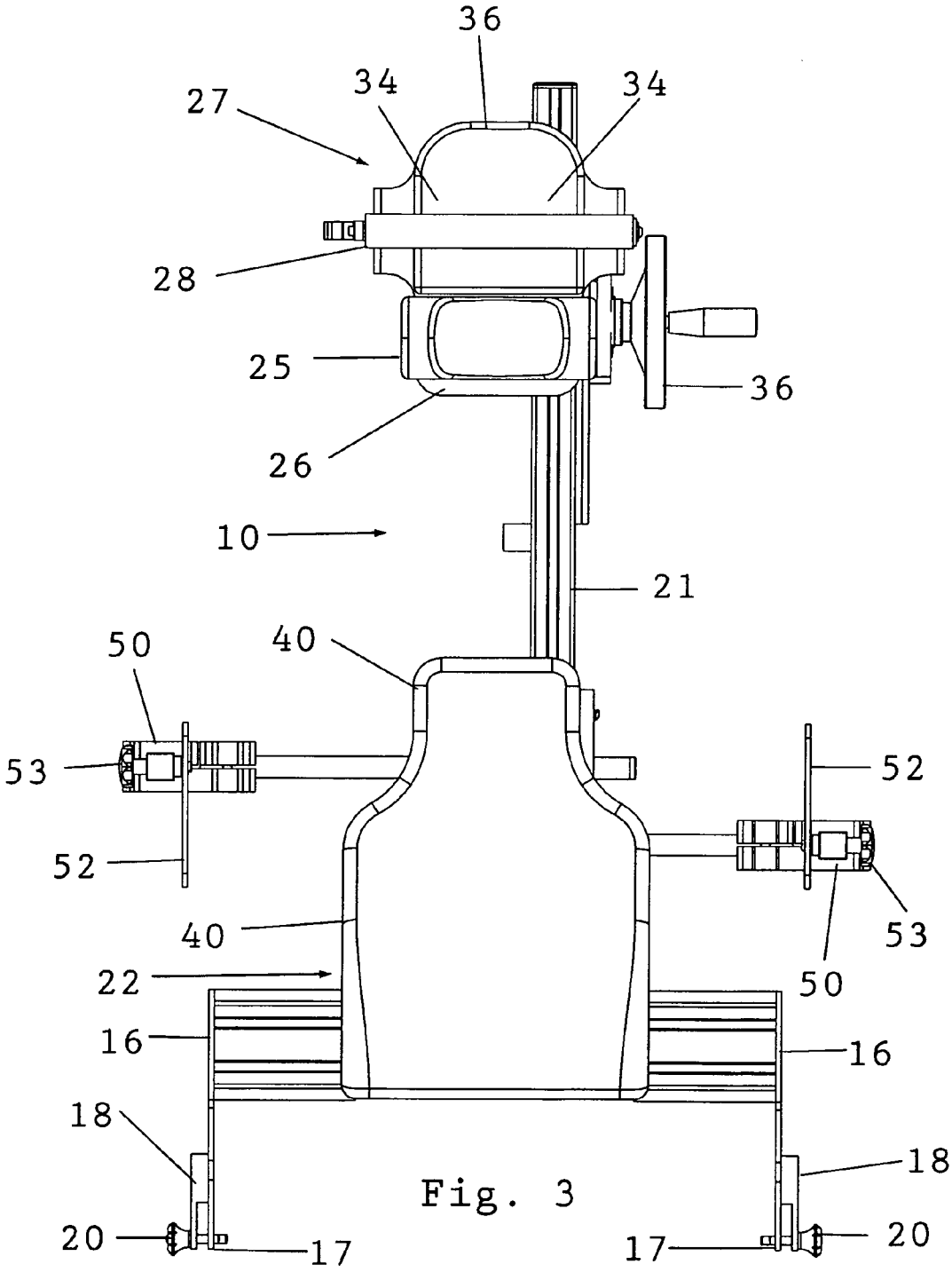
FIG. 3 is a front view of the shoulder surgery attachment shown in FIG. 1.
Figure 4:
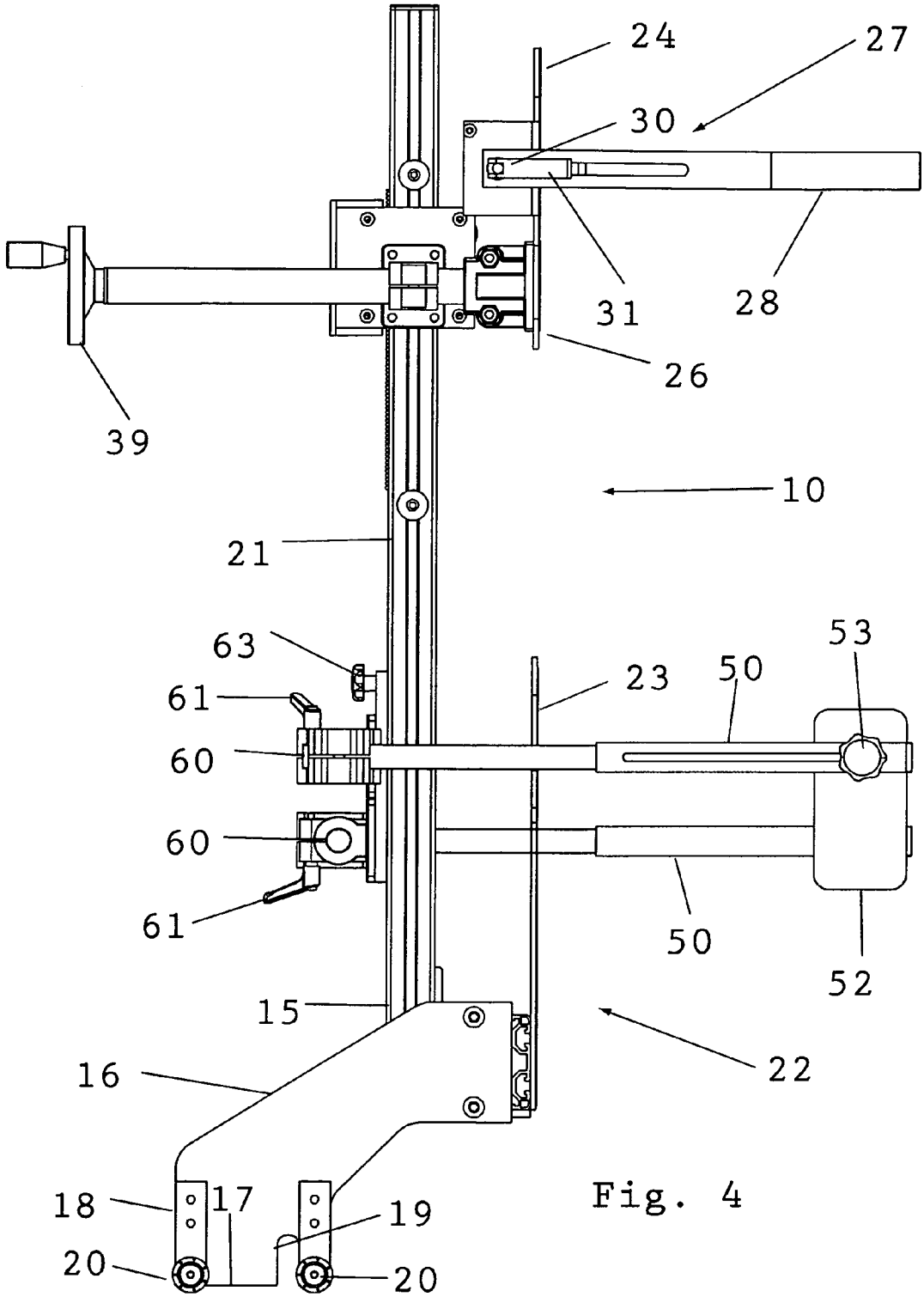
FIG. 4 is a left side view of the shoulder surgery attachment shown in FIG. 3 without the inclusion of forehead pads in the head clamp, neck support padding in the headrest and back support padding.
Figure 5:
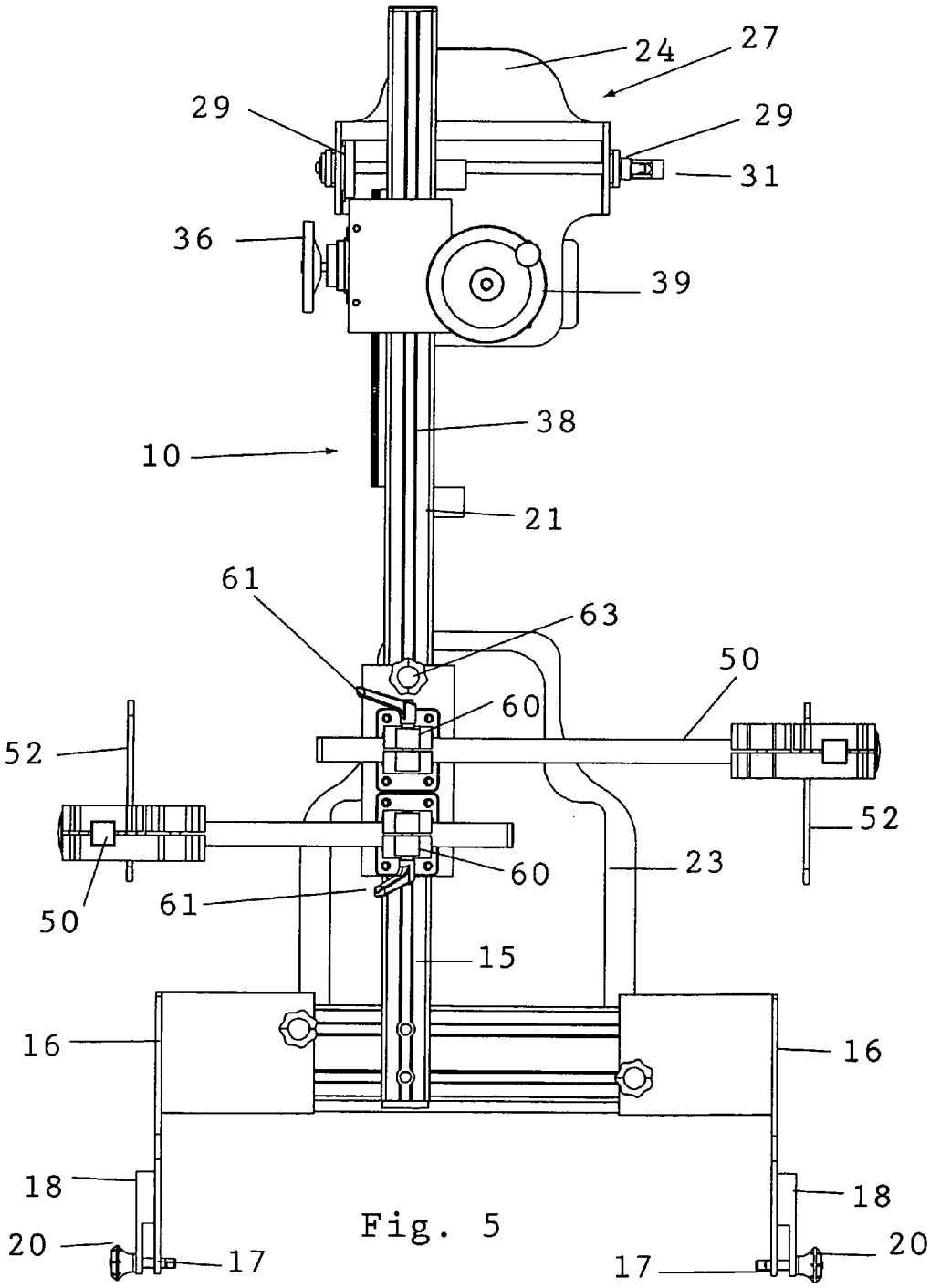
FIG. 5 is a back view of the shoulder surgery attachment shown in FIGS. 1 through 4.
Figure 6:
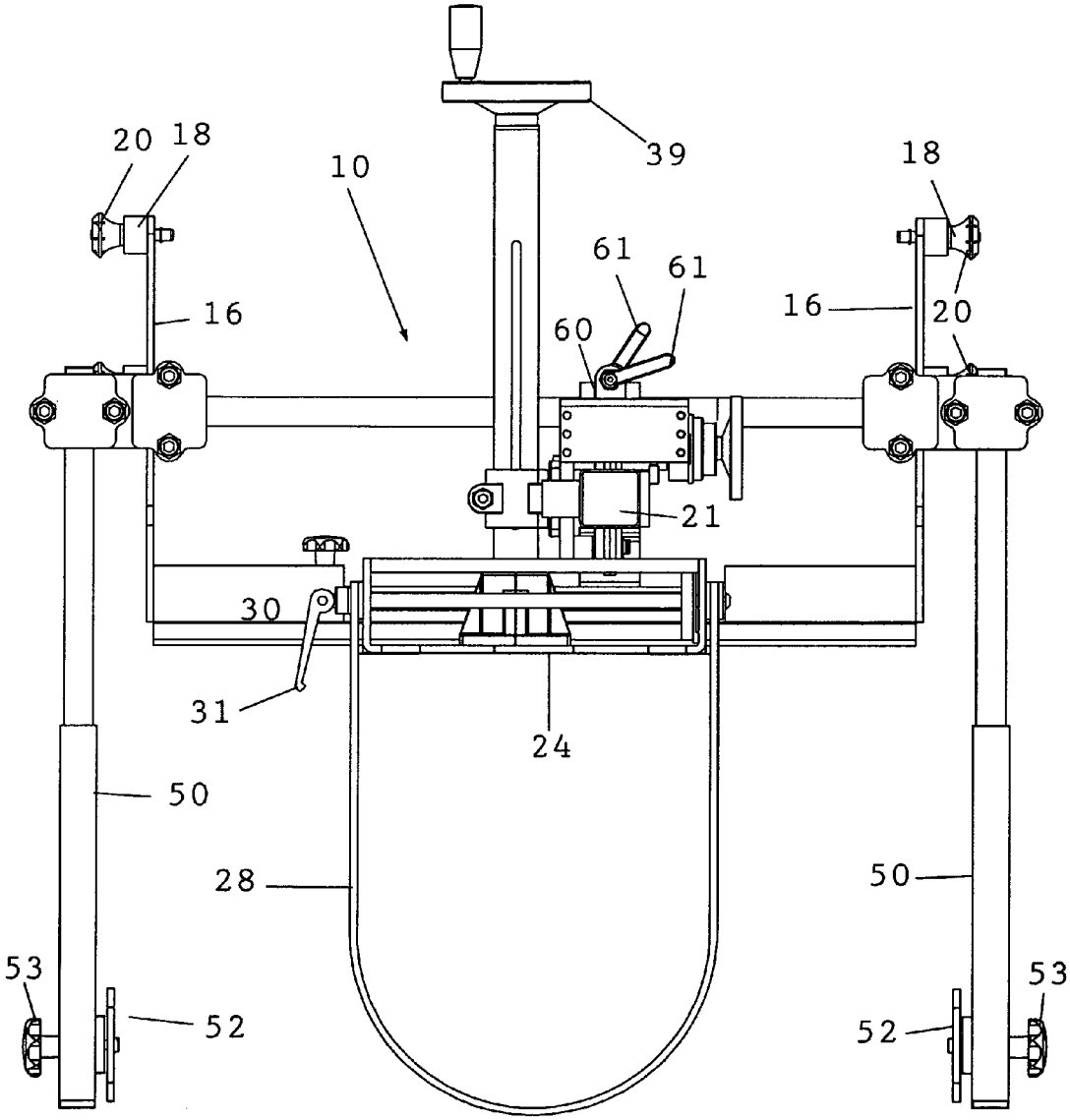
FIG. 6 is a top view of the shoulder surgery attachment illustrated in the prior figure without inclusion of the forehead clamp pads, neck support and back rest cushion support.

Headrest assembly 24 is also adjustably moveable in a direction transverse to the upright extension of chair back assembly 10, or in a left and right direction as seen in FIG. 2, by rotation of drive wheel 39. This moves the entire headrest assembly 24, together with the attached neck support 25 and pad 36 accordingly to the left or right as desired to properly align and position the head and neck support for the specific patient 33.

A contoured back rest support cushion 40 is positioned to freely slide against chair back 23 to permit the support cushion 40 to "float" in order to find the proper position to fit the back contours of the given patient 33. Knee lift support 41 is also provided and positioned under the patient's knees to provide the desired "beach-chair" positioning of the patient.

To further assist in retaining the patient securely against the back support 23 and support cushion 40, the shoulder surgery attachment 10 is further provided with side retainers 50 that protrude in a forward direction on opposite sides and are positioned for retaining and confining the sides of the patient's torso 51. These side retainers 50 are respectively provided with plates 52 that may be adjustably positioned along the distal ends of protruding side retainers 50 by releasing the clamping engagement of clamping screws 53, thereby permitting the plates 52 to be positioned along side retainers 50 and then clamped in position where desired.

A torso retainer 54 (FIG. 7) is provided in the form of a flexible material and is secured between the side retainer plates 52 by means of any conventional fastener, such as hook and loop fastening elements, in order to engage and retain the patient's torso 51 and thereby hold the patient's torso against the back support 23 and back support cushion 40. This prevents unwanted sliding down of the patient's body when under sedation.

Side retainers 50 may also be spread further apart or moved together to better fit the patient's torso 51 by means of clamp and release mechanisms 60 that are engaged and released by manipulation of clamp handles 61. Side retainers 50 may also be moved up and down support post 21 by releasing of clamp handle 63 for repositioning.

Figure 7:
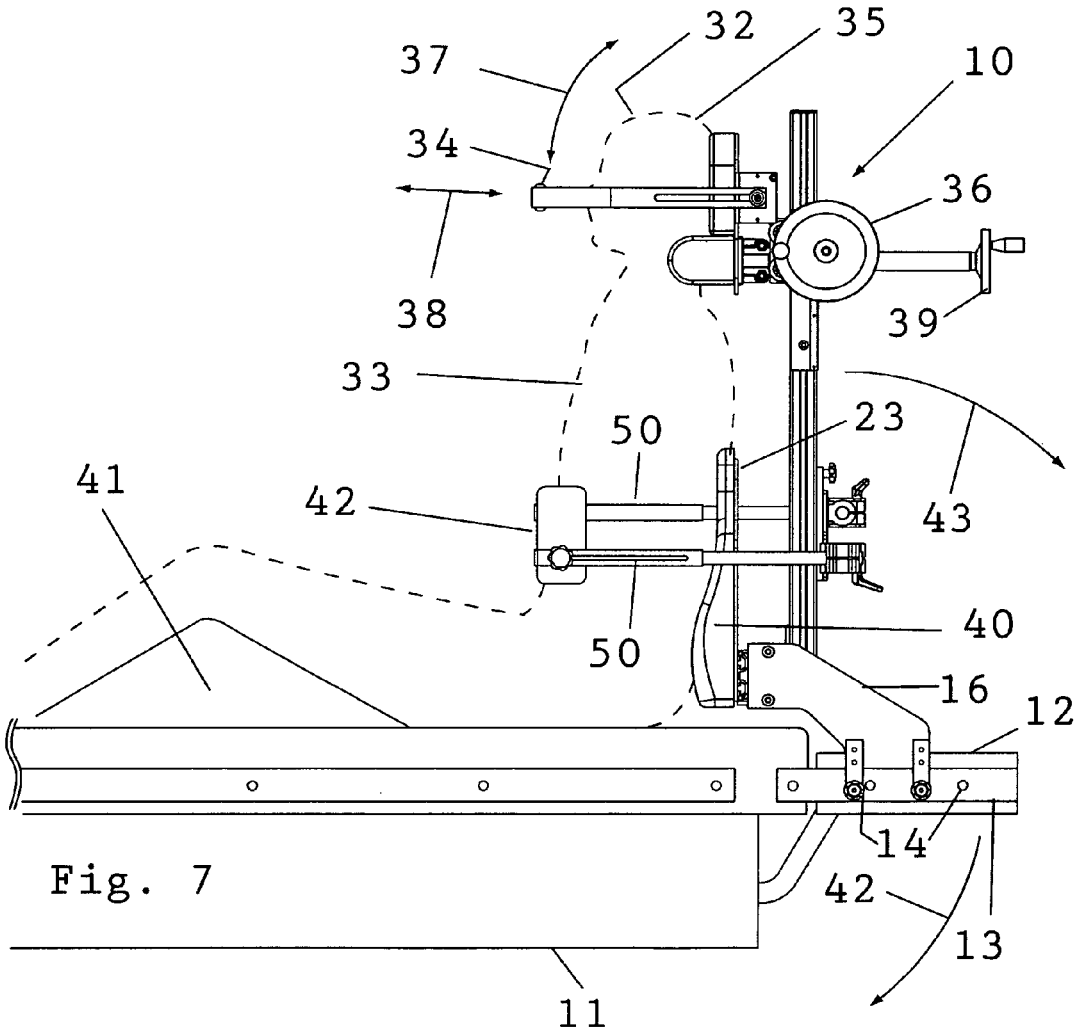
FIG. 7 is a left side view of the shoulder surgery attachment of the present invention as secured to a surgical table with a patient secured therein.

With particular reference to FIG. 7, the articulated leg section 12 of surgical table 11 may be adjustably lowered and positioned as indicated by arrow 42 to recline shoulder surgery attachment 10 to a desired position as indicated by arrow 43.

We claim:

1. A shoulder surgery attachment for a surgical table having an articulated leg section with accessory attachment rails on opposite sides thereof, wherein the shoulder surgery attachment comprises:

an upright chair back assembly having a front and back, a back support with a base on a bottom end thereof for attachment to said rails, and a headrest assembly positioned above said back support and including a removable neck support and a head fixation assembly, said headrest assembly adjustably moveable up and down said chair back assembly;

said neck support positioned below said head fixation assembly and protruding from the front of said headrest assembly for engagement with the back of a patient's neck;

said head fixation assembly including a forward protruding substantially rigid U-shaped forehead clamp having two rearwardly extending distal free ends adjustably secured to said headrest assembly for engaging said clamp against the forehead of a patient to clamp the patient's head against said headrest assembly.

2. The shoulder surgery attachment of claim 1, said headrest assembly also adjustably moveable in a direction transverse to the upright extension of said chair back assembly.

3. The shoulder surgery attachment of claim 1, said chair back assembly including side retainers adjustably protruding in a forward direction on opposite sides and positioned for retaining and confining the sides of a patient's torso.

4. The shoulder surgery attachment of claim 3, including a torso retainer extending between said side retainers for retaining a patient's torso against said back support.

5. The shoulder surgery attachment of claim 1, said forehead clamp including at least one clamp pad for engagement of a patient's forehead.

6. The shoulder surgery attachment of claim 1 including a contoured back rest support cushion positioned to freely slide against said chair back.

7. The shoulder surgery attachment of claim 6, including a knee lift support on said table for positioning under a patient's knees.

* * * * *